US007318470B2

(12) United States Patent
Demuth et al.

(10) Patent No.: US 7,318,470 B2
(45) Date of Patent: Jan. 15, 2008

(54) DEVICE FOR EXCHANGING HEAT

(75) Inventors: Walter Demuth, Gerlingen (DE); Martin Kotsch, Ludwigsburg (DE); Michael Kranich, Besigheim (DE); Christoph Walter, Stuttgart (DE); Karl-Heinz Staffa, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 458 days.

(21) Appl. No.: 10/499,712

(22) PCT Filed: Dec. 19, 2002

(86) PCT No.: PCT/EP02/14576

§ 371 (c)(1),
(2), (4) Date: Jun. 21, 2004

(87) PCT Pub. No.: WO03/054465

PCT Pub. Date: Jul. 3, 2003

(65) Prior Publication Data

US 2005/0006073 A1 Jan. 13, 2005

(30) Foreign Application Priority Data

Dec. 21, 2001 (DE) ..... 101 63 202
Jul. 26, 2002 (DE) ..... 102 34 118
Aug. 29, 2002 (DE) ..... 102 40 556

(51) Int. Cl.
*F28D 1/47* (2006.01)
*F28F 9/22* (2006.01)

(52) U.S. Cl. ..... 165/176; 165/144; 165/150

(58) Field of Classification Search ..... 165/110, 165/144, 150, 153, 174, 176
See application file for complete search history.

(56) References Cited

U.S. PATENT DOCUMENTS 4,962,811 A * 10/1990 Yamamoto ..... 165/173
5,036,909 A * 8/1991 Whitehead et al. ..... 165/133
5,174,373 A 12/1992 Shinmura
5,314,013 A * 5/1994 Tanabe ..... 165/176
5,542,271 A * 8/1996 Kudoh et al. ..... 62/502
RE35,742 E * 3/1998 Hoshino et al. ..... 165/150
6,145,587 A * 11/2000 Hanafusa ..... 165/153
6,484,796 B2 * 11/2002 Demuth et al. ..... 165/144
6,523,606 B1 * 2/2003 Dienhart et al. ..... 165/144

(Continued)

FOREIGN PATENT DOCUMENTS

DE 197 29 497 A1 1/1999

(Continued)

*Primary Examiner*—Allen J. Flanigan
(74) *Attorney, Agent, or Firm*—Foley & Lardner LLP

(57) ABSTRACT

The invention relates to a device for exchanging heat, particularly for use in motor vehicle air-conditioning systems, comprising at least one coolant, at least one coolant inlet (3), and at least one coolant outlet (4), which lead into at least one head pipe (7, 8, 9), whereby the head pipe (7, 8, 9) is divided into at least one inlet section (41') and into at least one outlet section (42') by at least one separating element (49). The device for exchanging heat comprises at least one flow-through element (19), which has at least two flow paths situated at least partially parallel to one another, and at least one cross-distributor (10', 10", 11', 11", 12) via which the flow paths of the flow-through element (19) are fluid-connected so that the inlet section is fluid-connected to the outlet section of the head pipe (7, 8, 9).

63 Claims, 14 Drawing Sheets

U.S. PATENT DOCUMENTS

| | | | | |
|---|---|---|---|---|
| 6,705,386 | B2 | 3/2004 | Demuth et al. | |
| 2002/0062953 | A1* | 5/2002 | Demuth et al. | 165/173 |
| 2005/0039901 | A1* | 2/2005 | Demuth et al. | 165/175 |

FOREIGN PATENT DOCUMENTS

| | | | |
|---|---|---|---|
| DE | 100 49 256 | A1 | 4/2002 |
| EP | 1 083 395 | A1 | 3/2001 |
| JP | 61-24953 | A | 2/1986 |
| JP | 62-131195 | A | 6/1987 |
| JP | 2-13788 | A | 1/1990 |
| JP | 4-68297 | A | 3/1992 |
| JP | 8-132857 | A | 5/1996 |
| JP | 2000-304472 | A | 11/2000 |
| WO | WO 03/054466 | A1 | 7/2003 |
| WO | WO 03/054467 | A1 | 7/2003 |

* cited by examiner

DEVICE FOR EXCHANGING HEAT

BACKGROUND OF THE INVENTION

The invention relates to a device for exchanging heat, in particular for use in motor vehicles and in particular for use in motor vehicle air-conditioning systems, Such devices are used, for example, as condensers and evaporators in motor vehicle air-conditioning systems.

The present invention will be discussed with reference to motor vehicle air-conditioning systems, although it should be pointed out that the device for exchanging heat may be used in other air-conditioning systems or for the transfer of heat between two media.

Such devices for exchanging heat are already known, and are used in particular for the air-conditioning of a passenger compartment in a motor vehicle.

Only incombustible coolants are currently used in these air-conditioning systems, since combustible coolants increase the safety risk for people in the motor vehicle passenger compartment owing to the potential danger of explosion. Such coolants are in particular coolants which absorb heat by evaporation at a relatively low temperature and a low pressure, and release heat by liquefaction at a high temperature and a high pressure.

Coolants, for example conventional coolants such as R22 (chlorodifluoromethane), are generally used at present in air-conditioning systems. In even older systems, the coolant R12 (dichlorodifluoromethane) is still found, although its use in cooling systems and air-conditioning systems has been banned for a long time. Since the year 2000, the same has applied to the coolant R22.

The banning of other coolants is also under consideration, for example R134a, so there is an incentive to use alternative coolants.

Such coolants may, for example, be substances or substance compositions which have $CO_2$ as at least one component.

It is an object of the present invention to provide a device for exchanging heat which makes it possible to use alternative coolants and, at the same time, improves the efficiency and economic viability of such apparatus.

SUMMARY OF THE INVENTION

The invention achieves this object by providing a device according to an embodiment of the present invention. Such a device can be operated with at least one coolant which makes it possible to transport thermal energy inside the device and the components which are in flow communication with the device.

The device furthermore has at least one coolant inlet and at least one coolant outlet, which open in at least one head tube (or also called a header tube) according to a preferred embodiment.

According to a preferred embodiment, the head tube (or header tube) itself is subdivided by at least one partition element into at least one inlet section and at least one outlet section, which are preferably assigned to a respective coolant inlet and a respective coolant outlet.

The inlet and outlet sections of the head tube, which are separated from one another in a liquid-tight and/or gas-tight manner by at least one partition element, are fluidically connected by means of at least one flow device and preferably at least one transverse distributor. The flow device has at least two flow paths oriented mutually parallel at least in sections, the openings of which open into the inlet and outlet sections of the head tube, or into the channel of at least one transverse distributor.

According to a preferred embodiment of the present invention, at least one head tube, at least one coolant inlet, at least one coolant outlet, at least one flow device and at least one transverse distributor form components which, when assembled together, form a module in the scope of the present invention.

According to a preferred embodiment of the present invention, at least two modules of the aforementioned type are connected together so that the coolant inlets and coolant outlets, respectively, are fluidically connected together.

According to a particularly preferred embodiment, the coolant inlets and coolant outlets are tubes with a defined cross section, in whose circumference bores are made which are arranged essentially perpendicular to the longitudinal mid-axis of the coolant inlet tube or coolant outlet tube, and according to a particularly preferred embodiment, intersect the longitudinal mid-axes of the coolant inlet tubes and coolant outlet tubes with their midline or are arranged at a predetermined distance from it.

According to a particularly preferred embodiment, the midline of the bore is offset from the longitudinal mid-axis of the head tube, so that it constitutes a tangent to the outer circumference of the coolant inlet tube or coolant outlet tube, respectively.

According to another preferred embodiment, the device for exchanging heat comprises modules which are hydraulically connected in parallel by means of coolant inlets and coolant outlets, that is to say coolant is delivered to and discharged from the head tube sections in parallel.

For example, the modules are connected with two coolant tubes so that the inlet sections of the head tubes are fluidically connected via a coolant inlet tube and, correspondingly, the outlet sections of the head tubes are fluidically connected by means of a coolant outlet tube.

According to a particularly preferred configuration, two modules hydraulically connected in parallel communicate with one another via at least one transverse distributor. On the one hand, such a connection insures pressure equilibration of the two modules at respectively determined positions inside the modules, so that more uniform exposure of the modules to coolant is possible where applicable. On the other hand, blending of the coolant flows in the modules is made possible under certain circumstances, which under certain circumstances entails a more uniform temperature distribution over the device for exchanging heat.

According to one embodiment of the present invention, the coolant inlets and outlets, respectively, of a plurality of interconnected modules are formed integrally.

According to a preferred embodiment, the coolant inlets and outlets, the head tube and the transverse distributor are arranged on one side of the module.

The module then in particular has an approximately square basic shape, which preferably has a front face and a back face which, according to a particular embodiment, constitute the sides of the module through which essentially the gaseous medium flows, for example air, in order to release or absorb energy, in particular heat energy. These front and back faces of the module are bounded by four side faces, which are essentially defined by the width of the flow device being used and the cooling fins attached to them and their configuration.

Alternative designs to this preferred rectangular basic shape may be nevertheless selected, which in particular correspond to the requirements for arrangement in an air-conditioning system or a ventilation device.

It is also within the scope of the present invention for the coolant inlets and outlets, the head tube and the transverse distributor to be arranged on different sides of the module, this having a direct effect on the position and the profile of the flow device, as will be discussed in more detail below.

According to another embodiment of the present invention, the arrangement of the components of a module is dictated by the arrangement of the flow device. In particular the alignment of the flow paths, the number of curves and the curvature angle, which according to the present invention is between 0° and 180°, preferably between 30° and 110° and particularly preferably between 45° and 90°, defines the position of the other components on or in the device.

According to a particularly preferred embodiment, the flow device has between 1 and 10 curves, the head tubes and the transverse distributors being arranged on the same or opposite sides of the module, depending on the even or odd number of 180° curvature angles.

For example, in the case of 2, 4, 6, 8 and 10 curves with a curvature angle of 180° for the flow device, the head tubes are arranged on the opposite side to the transverse distributors of a module. In the case of 1, 3, 5, 7 and 9 curves with a curvature angle of 180°, the head tubes and the transverse distributors of a module are arranged on one side of the module.

According to a preferred embodiment, the segments of the flow device between the head tube and the flow device, or between two curves of the flow devices, are essentially of equal length.

According to a particularly preferred embodiment of the present invention, the segments of the flow device which comprise the openings of the flow paths may differ from the length between two curves of the flow device.

According to another particularly preferred embodiment, the openings of the flow paths of the flow device open into the interior of the head tube or of the transverse tube. The components are furthermore connected together by material bonding, by friction locking and/or by a form-fit, so that the interior of the components is gas-tight and/or liquid-tight in particular even at high pressures of up to about 300 bar, or the flow paths are gas-tight and/or liquid-tight in particular even at high pressures of up to about 300 bar.

According to a preferred embodiment of the present invention, the partition element, which subdivides the head tube into an inlet section and an outlet section, is connected to the head tube so as to prevent gaseous or liquid media from being exchanged between the sections.

According to another particularly preferred embodiment, the flow device is a flat tube, the channel of which is subdivided into at least two flow paths by plates.

The flat tube is furthermore characterized in cross section by the width, which is between 10 mm and 200 mm, preferably between 30 mm and 70 mm, and by a height which is between 1.0 mm and 3 mm, preferably between 1.4 mm and 2.4 mm, and an outer wall thickness which is between 0.2 mm and 0.8 mm, preferably between 0.35 mm and 0.5 mm.

The flow paths furthermore have a circular or elliptical shape in cross section, which however is matched to the outer contours of the flat tube, in particular in the edge region of the flat tube, so as not to fall below a minimum wall thickness.

According to a preferred embodiment, the flow device may also have two flat tubes, which are arranged mutually parallel at least in sections and the channels of which constitute at least one flow path.

According to a particularly preferred embodiment, the components, in particular the flow device, for example the flat tubes, are made of at least one material which is selected from the group of materials which contains metals, in particular aluminum, manganese, magnesium, silicon, iron, brass, copper, tin, zinc, titanium, chromium, molybdenum, vanadium and their alloys, in particular wrought aluminum alloys with a silicon content of from 0 to 0.7% and a magnesium content of between 0.0-1%, preferably between 0.0-0.5% and particularly preferably between 0.1 and 0.4%, preferably EN-AW 3003, EN-AW 3102, EN-AW 6060 and EN-AW 1110, plastics, fiber-reinforced plastics, composites etc.

According to another preferred embodiment, a module has cooling fins as a further component, which are connected in particular to a region of the outer surface of the flow device so that the transport of thermal energy is promoted.

According to a particularly preferred embodiment, the cooling fins are connected by material bonding to the surface of the flow device, in which case soldering methods, welding methods and adhesive methods in particular are used to produce the material bond.

The cooling fins are preferably connected to the surfaces of the flow device so that the material bonding takes place in particular at the turning points of the cooling fins.

According to a particularly preferred embodiment, the cooling fins have a coil-like basic structure in the flow direction, the depth of which corresponds essentially to the overall depth of the module, or the width of the flow device. Slots, which extend essentially between the two connection points or turning points of the cooling fins, may furthermore be made in the cooling fins.

According to a particularly preferred embodiment, these slots in the cooling fins are between 1 and 15 mm, preferably between 2 and 13 mm and particularly preferably from 3.7 to 11.7 mm long. The slots furthermore have a width of between 0.1 and 0.6 mm, preferably between 0.1 and 0.5 mm and particularly preferably between 0.2 and 0.3 mm. These so-called "gills" of the coolant fins allow improved heat transfer between the gas flowing through and the cooling fins, or the walls of the flow devices. The cooling fins are furthermore characterized by a wall thickness which is between 0.01 and 0.5 mm, preferably between 0.02 and 0.07 mm and particularly preferably between 0.07 and 0.15 mm. The fin density of the cooling fins is from 10 to 150 fins per dm, preferably from 25 to 100 fins per dm and particularly preferably from 50 to 80 fins per dm. In a particularly preferred embodiment, the fin height is from 1 to 20 mm, preferably from 2 to 15 mm and particularly preferably from 3 to 12 mm.

According to a preferred embodiment, the head tube has an essentially cylindrical basic shape, in the circumference of which a predetermined number of feeds are arranged, through which the coolant inlets and outlets and at least one flow device, in particular a flat tube, extend into the interior of the head tube.

According to a particularly preferred embodiment, the feeds for the flat tubes in the interior of the head tube are configured so that not only are the flat tubes connected to the head tube by means of a material bond, but also a flat tube or flat tubes, once inserted, are connected by friction locking to the walls of the head tube through additional compression of the head tube.

According to a particularly preferred embodiment, the head tube for this connection method has a basically Ω-shaped cross section, in the narrowest region of which the feeds are provided for the flow devices, in particular for a flat tube. According to another embodiment, a plurality of flat tubes may also be accommodated in one or more feeds.

According to a particularly preferred embodiment, the feeds have an outer contour which corresponds to that of the object to be inserted, in particular to that of the coolant inlet or coolant outlet tube, and to that of the flat tube, or are at a predetermined distance from it.

The holes are furthermore arranged offset, with reference to their midline, by a predetermined distance from the midline of the head tube, or of the transverse distributor.

The holes are arranged at a predetermined distance from the mid-axis of the head tube.

According to an advantageous configuration, the head tube has a projection on an edge of at least one feed, which engages in a feed of the coolant inlet or outlet. This fixes the head tube with respect to the coolant inlet or outlet during assembly of the device, which facilitates manufacture of the device for exchanging heat.

In a preferred embodiment, a coolant which has at least one component from a group which comprises gases, in particular carbon dioxide, nitrogen, oxygen, air, ammonia, hydrocarbons, in particular methane, propane, n-butane and liquids, in particular water, floe-ice, sols, etc. is used in the device for exchanging heat.

According to a particularly preferred embodiment, carbon dioxide, the physical properties of which as a colorless incombustible gas can be used to increase the cooling power, possibly reduce the size of the apparatus or reduce power losses, is used as the coolant.

According to a preferred embodiment, a preferably gaseous medium, in particular air, flows around the device for exchanging heat in full, and moreover at least the flow device as a component of the device, and in particular the cooling fins.

According to a particularly preferred embodiment, the heat transfer between the coolant inside the flow device and the gaseous medium, flowing around the cooling fins and the flow device, takes place essentially by convection and heat conduction. For example, the air flowing around releases heat energy to the cooling fins, from which the heat can be transferred via the cooling fins and the wall of the flow device to the coolant.

For heat conduction, the component of the module and the modules are connected together so as to promote the transport of thermal energy. This is done, in particular, by a connection using material bonding, friction locking and a form-fit, for example soldering, welding, flanging or adhesive bonding.

The junction regions of the components and modules through which fluid flows are furthermore connected together in a gas-tight and liquid-tight manner so as to prevent mixing of the coolant with the medium flowing around. In particular when coolants with a low molecular weight are used, for example carbon dioxide, it is particularly important to obtain a connection between the components and the modules which prevents the coolant, or components of the coolant, from escaping.

In a preferred embodiment, the device for exchanging heat has frame elements on two mutually opposite sides, which extend over at least a part of the side area of the device. These frame elements are preferably profiled elements which, inter alia, may have a U-shaped, V-shaped, L-shaped or other typical profiled structures. These frame elements are furthermore connected by friction locking and/or by a form-fit to at least one component in the device for exchanging heat. Material bonding, for example by soldering, welding and adhesive bonding, also lies within the scope of the invention.

According to another particularly preferred embodiment of the device for exchanging heat, the flat tube has at least one recess in the vicinity of the feeds that enter the head tube, in which for example the partition element which subdivides the head tube into an inlet section and an outlet section engages.

In another embodiment, the device for exchanging heat has a partition element with a recess in which the flow device, in particular a flat tube, engages in the head tube in the vicinity of the feed.

This arrangement insures that the regions of the inlet section and of the outlet section in the head tube are sealed from one another in a liquid-tight or gas-tight manner, and defined positioning and fastening of the flow device is insured.

According to another embodiment, the head tubes and/or the coolant inlet or outlet are configured so that the pressure of the coolant is essentially equal or has a predetermined value over the inlet or outlet sections.

Preferably for the coolant inlet, under certain circumstances this can be achieved in that the flow cross section of the coolant inlet tapers over the number of head tubes fluidically connected to it, so that the pressure drop at each "take-off point" is substantially compensated for. In this case, it is particularly preferable for the coolant outlet to have a flow cross section that is as large as possible.

Alternative embodiments lie within the scope of the present invention, and in particular the configuration of the opening or the coolant feed of the head tube, or its size, may likewise be used to equilibrate the pressure or density level of the head tubes arranged on the coolant inlet.

According to a particularly preferred embodiment, the various take-off points from the coolant inlet or outlet may also be subdivided into flow regions by using a profile which is inserted and connected to the sleeve tube by material bonding. For example, the tube is subdivided into 2, 3 or 4 or more flow regions. The flow regions of the coolant inlet or coolant outlet are connected to the corresponding take-off regions, for example the bore which opens into the head tube, by a predetermined rotation of the profile in the tube.

According to another preferred embodiment, the volumes of the inlet and outlet sections of a head tube have a predetermined ratio to one another, in which case this ratio may in particular be 1:1, 1:2, 1:4, 1:10 and any intermediate values between these. In particular, this accommodates the varying density of the coolant when it evaporates or cools.

When the device for exchanging heat is used as an evaporator, for example, this arrangement can accommodate the fact that the volume increases significantly when the coolant evaporates, so that a larger flow cross section is needed for transporting the mass flow of coolant.

For example, the density ratio for $CO_2$ between a coolant inlet and a coolant outlet is between 1:2 and 1:10, preferably between 1:3 and 1:7, and particularly preferably about 1:5.

A simplified design is facilitated according to another advantageous embodiment of the invention by tubes restructured in a U-shape, the tubes being restructured once or several times, for an even simpler design. This may possibly obviate a transverse distributor in the vicinity of the U-shaped restructuring. If only U-tubes are used, it is even possible to place all the head tubes and transverse distributors on one side of the device.

According to a preferred configuration, a transverse distributor connects together flow paths which are arranged one behind the other in a primary flow direction of a medium flowing around the flow device. This makes it possible to interconnect flow paths for the coolant either parallel or antiparallel with a primary flow direction of a medium flowing around the flow device. This leads to an at least partial counterflow design of the device for exchanging heat.

According to a preferred configuration, the number of flow paths of at least one module is divisible by two. This means that a two-row arrangement of the flow paths can be readily interconnected by arranging the first half of the flow paths of a module in a first row and connecting them together, while the second half of the sections is arranged in a second row and likewise connected together, the two halves of the module being connected together with overlap of the rows. This connection with overlap of the rows is carried out, for example, in a transverse distributor on an opposite side of the device for exchanging heat to the coolant inlet and outlet.

The number of flow paths of the module is particularly preferably divisible by four. This means that in the case of a two-row arrangement of the flow paths with the interconnection described above, the connection with overlap of the rows is carried out on the same side of the device for exchanging heat as the one where the coolant inlet and the coolant outlet are located.

In one configuration, the outermost flow paths within one or more flow-path rows are not exposed as hydraulically first flow paths of modules since, in the outermost regions of the coolant inlet or outlet, the flow and/or pressure conditions of the coolant may possibly be unfavorable for the exposure of modules.

According to an advantageous embodiment, the flow paths of two neighboring modules extend with mirror symmetry with respect to one another. In particular, this facilitates communication between the neighboring modules via a transverse distributor.

In another preferred embodiment, a flow cross section of a module changes along a coolant flow profile inside the module. This is very easy to do, for example by connecting a small number of flow paths to a large number of flow paths via appropriately configured transverse distributors. Adaptation of the flow cross section of a module to a density of the coolant varying along the module is particularly preferred.

A configuration in which all the flow paths of at least one module are flush with one another in the primary flow direction of a medium flowing around the flow device is advantageous. It is particularly advantageous for all the modules of the device for exchanging heat to be designed in this way, which facilitates a pure counterflow design of the device in a straightforward way, namely by appropriately arranged transverse distributors.

According to another preferred embodiment, at least one transverse distributor has a second partition element which subdivides the transverse distributor into at least two flow sections.

A device for exchanging heat according to a preferred embodiment furthermore has at least one flow device which extends into the interior of a transverse distributor.

According to a particularly preferred embodiment, an apparatus for exchanging air, in particular for motor vehicle air-conditioning systems, with air flow paths and airflow control elements, has at least one air delivery device and, in a housing, a holding device in which at least one device for exchanging heat, is accommodated or arranged.

At least one device for exchanging heat is furthermore arranged in an apparatus for exchanging heat which, in particular, is intended for motor vehicle air-conditioning systems with at least a condenser, a compressor, a throttle and a manifold.

It should furthermore be pointed out that besides an exactly cylindrical or tubular configuration, the essentially cylindrical head tubes, coolant inlets and coolant outlets, and the transverse distributor, may also have modified shapes which, for example, are deformed cylindrical or elliptical, polygonal or rectangular cross sections.

Advantages, features and possible applications of the present invention can be found in the description of the exemplary embodiments in conjunction with the claims and the drawings.

The exemplary embodiments are not intended to imply limitation of the invention. Rather, many changes and modifications are possible in the scope of the present disclosure, in particular those variants of the elements and combinations and/or materials which, for example, may be found by the person skilled in the art with a view to achieving the object by combining or altering individual features or elements or method steps described in connection with the the general description, embodiments, and the claims, and contained in the drawings, and which lead by combinable features to novel subject-matter or to novel method steps, or method steps insofar as they relate to production, testing and working methods.

BRIEF DESCRIPTION OF THE DRAWINGS

Preferred aspects of the invention will be described below with reference to the figures, in which.

DETAILED DESCRIPTION OF THE DRAWINGS

Figure 1:
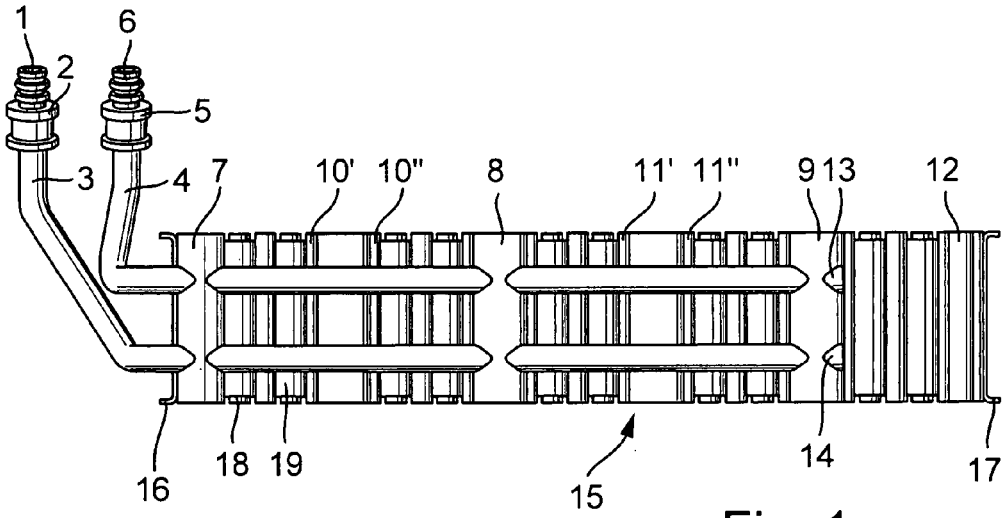
FIG. 1 shows a plan view of a device for exchanging heat according to the present invention.

Accordingly, FIG. 1 shows the plan view of a device for exchanging heat, in particular an evaporator, in which the coolant is delivered via the coolant inlet 1 and the subsequent coolant inlet tube 3 from the coolant circuit, for example of an air-conditioning system. Here, the entry section has a split seal which is connected to the further pipe system, for example in combination with a detachable coupling connection 2. The coolant inlet tube 3 opens into a first head tube 7 and, subsequent to this, is forwarded to the two head tubes 8 and 9. The coolant inlet tube is closed in a gas-tight or liquid-tight fashion at the position 7. This is done, in particular, by the incorporation of a partition element that is soldered in, or by welding. It is also in the scope of the present invention to close the tube by bending.

According to a particularly preferred embodiment, the head tubes 7, 8 and 9 have at least one partition element (not shown) which is arranged, for example, in the middle of the head tube. By means of this, the head tubes are subdivided into at least two sections from which the coolant is introduced into the flow device 19 and is conveyed, via the flow paths of the flow device, into the transverse distributors 10', 10", 11', 11" and 12. The coolant, which has already absorbed heat to some extent from the medium flowing around, flows from there for example into the rear region of the transverse distributor, and is in turn conveyed from this into the rear flow paths of the flow device 19. At the end, these flow paths open into the outlet section of the head tube 7, 8 and 9 and are fed back via the coolant outlet tube 4 into the pipe system of the air-conditioning system. Here as well, for example, the coolant return tube has a seal 6 and, for example, a coupling system 5 for connection to the pipe system. Besides the components of the device for exchanging heat that carry the coolant, this embodiment also has frame elements 16 and 17. The reference 18 denotes the position of the cooling fins for the device.

Figure 2:
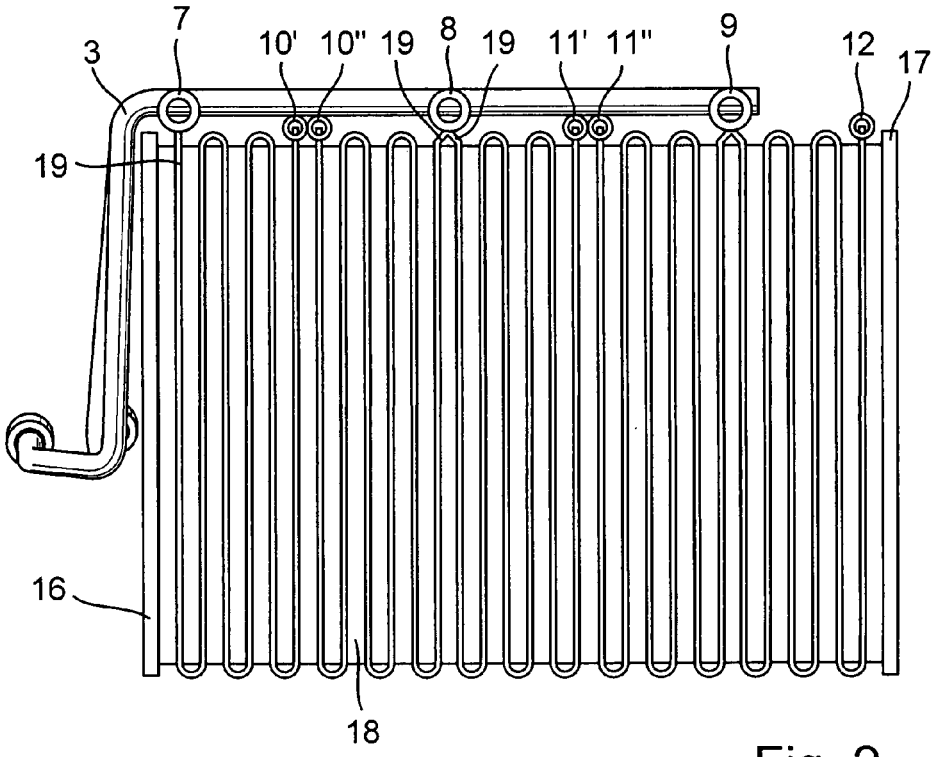
FIG. 2 shows a side view of a device for exchanging heat according to the present invention in FIG. 1.

In accordance with the plan view in FIG. 1, FIG. 2 shows the side view of a device for exchanging heat in which, in particular, a preferred embodiment is represented for the head tubes and the transverse distributors. Here, the head tubes and the transverse distributors exhibit a round cross section, in particular with two flow devices 19 respectively opening into the head tubes 8 and 9.

According to this exemplary embodiment, in particular, the flow device is a flat tube which is bent in a coiled fashion and provides the connection between the head tube and the transverse distributor. Cooling fins 18, in particular, are arranged between the respective coil sections of the flow device and improve the heat transfer between the medium flowing through, for example air, and the coolant flowing in the flow device.

According to a particularly preferred embodiment, the cooling fins are configured so that they likewise extend in a coiled fashion between the coil sections of the flow device, and are additionally provided with so-called gills over the depth of the device for exchanging heat, that is to say with slots which are used, in particular, to produce turbulence and hence for improved heat transfer between the medium flowing through and the cooling fins that dissipate heat.

The representation in FIG. 2 furthermore clearly shows that the flow device, in particular the flat tube, has a particular penetration depth into the transverse distribution tubes, or into the head tubes. The end pieces of the coil sections, which open in the head tube or in the transverse distribution tube, are also made longer in order to present a predetermined spacing of the head tube or of the transverse distribution tube from the base body of the device for exchanging heat, through which heat essentially flows.

Figure 3:
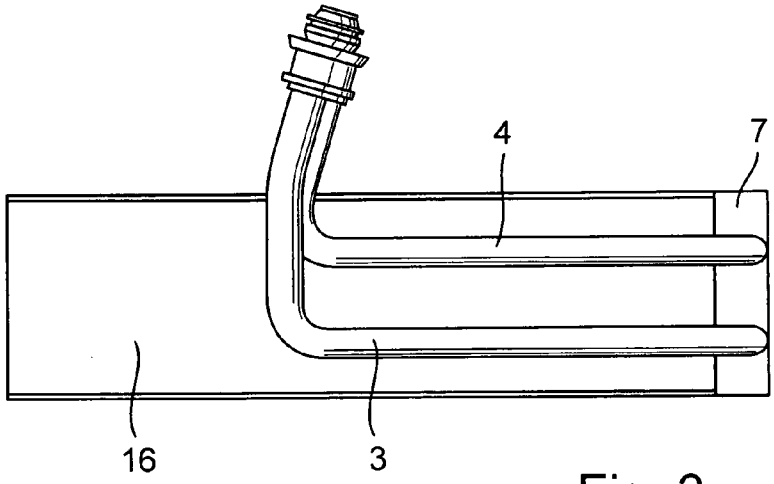
FIG. 3 shows a side view of the coolant inlet or outlet for a device for exchanging heat according to the present invention in FIG. 1.

FIG. 3 shows the side view from the left of a device for exchanging heat according to FIG. 1 and FIG. 2. The coolant efflux 4 and the coolant influx 3 and the head tube 7 can also be seen besides the frame element 16.

Figure 32:
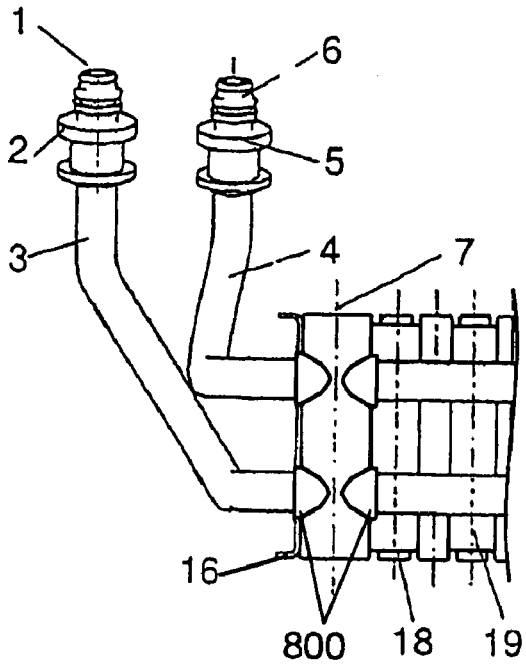
FIG. 32 shows a view of the head tube of FIG. 1 with a protrusion which engages in a feed of the coolant inlet and outlet.

According to an advantageous configuration seen in FIG. 32, the head tube or header tube 7 of FIG. 1 has projections 800 on an edge of at least one feed, which engages in a feed of the coolant inlet or outlet. This fixes the header tube 7 with respect to the coolant inlet or outlet during assembly of the device, which facilitates manufacture of the device for exchanging heat.

Figure 4:
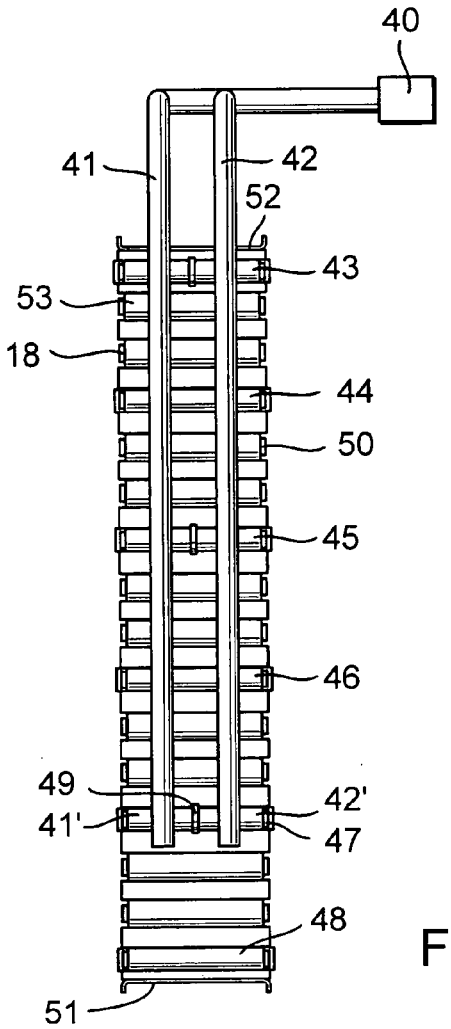
FIG. 4 shows a plan view of an alternative embodiment of a device for exchanging heat according to the present invention.

FIG. 4 shows an alternative embodiment of a device for exchanging heat in which, besides the coolant inlet 41, it is also possible to see the coolant outlet 42 a tube connection device 40 and the head tubes 43, 45 and 47. According to a particularly preferred embodiment the partition elements 49, which subdivide the head tubes 43, 45 and 47 into an inlet section 41' and an outlet section 42', can also be seen in this representation. The flow device 53 connected to the head tube 43, 45 and 47 opens into the transverse distribution tubes 44, 46 and 48. FIG. 4 furthermore shows the frame elements 51 and 52 and the cooling fins 18, which protrude from the flow device 53.

According to a particularly preferred embodiment, the transverse distributors and the head tubes are closed in a fluid-tight fashion at their outer limits by means of additional partition elements. These partition elements are preferably connected to the head tube, transverse distribution tube or the coolant inlet or coolant outlet tube by material bonding, friction locking and/or a form-fit.

Figure 5:
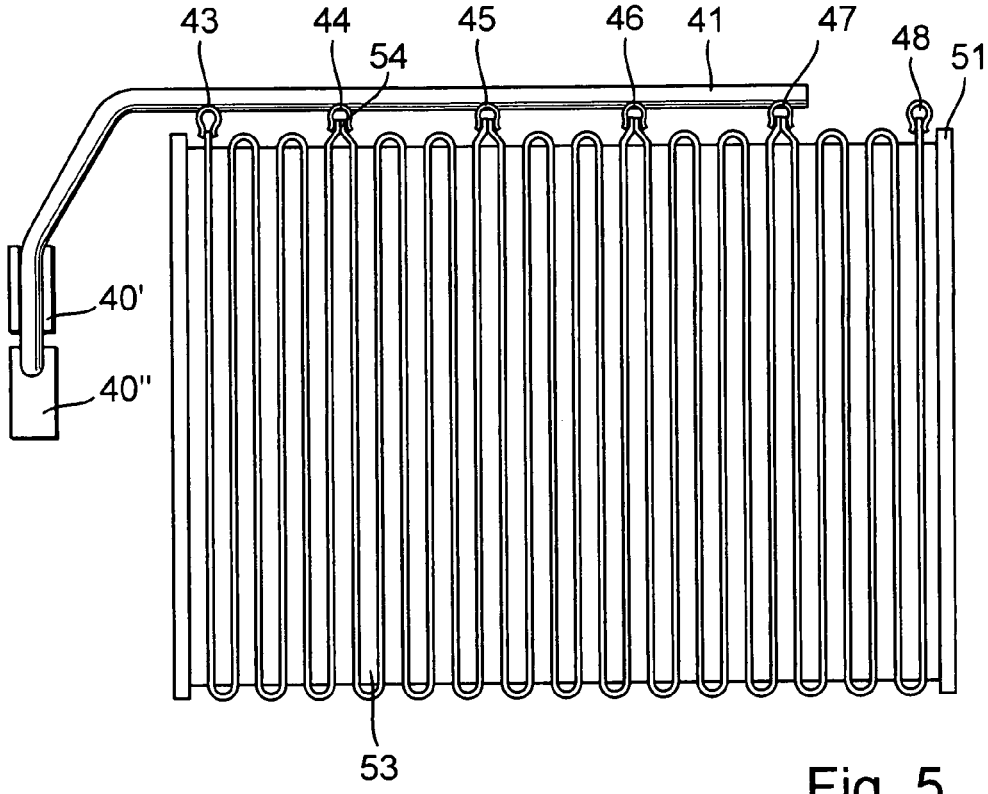
FIG. 5 shows a side view of a device for exchanging heat in FIG. 4.

FIG. 5 shows the alternative embodiment according to FIG. 4 in the side view, where the connection device 40' and 40" for the coolant inlet or coolant outlet can be seen in particular. The Ω-shaped configuration of the head tubes 43, 45 and 47 and of the transverse distribution tube 44, 46 and 48 can also be seen.

According to a particularly preferred embodiment, these tubes have an Ω-shaped cross section, in whose constriction region recesses are provided, for example, through which the flow devices are accommodated. Here, it should be emphasized particularly that the flow device has a predetermined penetration depth into the head tube or the transverse distribution tube, and that the flow device may be clamped to the head tubes or transverse distributors in order to assemble the components when producing the device for transferring heat. According to a particularly preferred embodiment, the penetration depth is from 0.01 to 10 mm, preferably from 0.1 to 5 mm and particularly preferably from 0.15 to 1 mm. The head tubes 45 and 47, or the transverse distributors 44 and 46, furthermore exhibit embodiments in which two flow devices open into the interior of the head tubes or transverse distributors. Here, the outlet branches of the head tubes or of the transverse distributors are adapted to the entry angle of the flow devices so that they extend parallel to it at least in one section.

Figure 6:
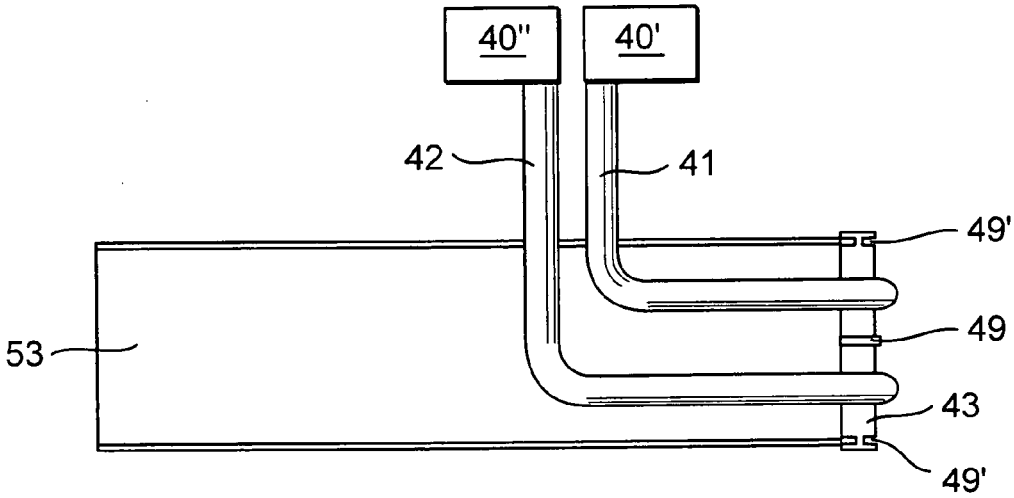
FIG. 6 shows a side view of the coolant inlet or outlet for a device for exchanging heat according to the present invention in FIG. 4.

FIG. 6 represents the side view of the alternative embodiment from the left in FIG. 5, where the coolant inlet 41 and coolant outlet 42 are represented besides the connection device 40' and 40'". The partition element 49 and the outer partition elements of the head tube 43 can also be seen with the references 49' and 49". The frame element 53 follows on laterally from the device for exchanging heat.

Figure 7:
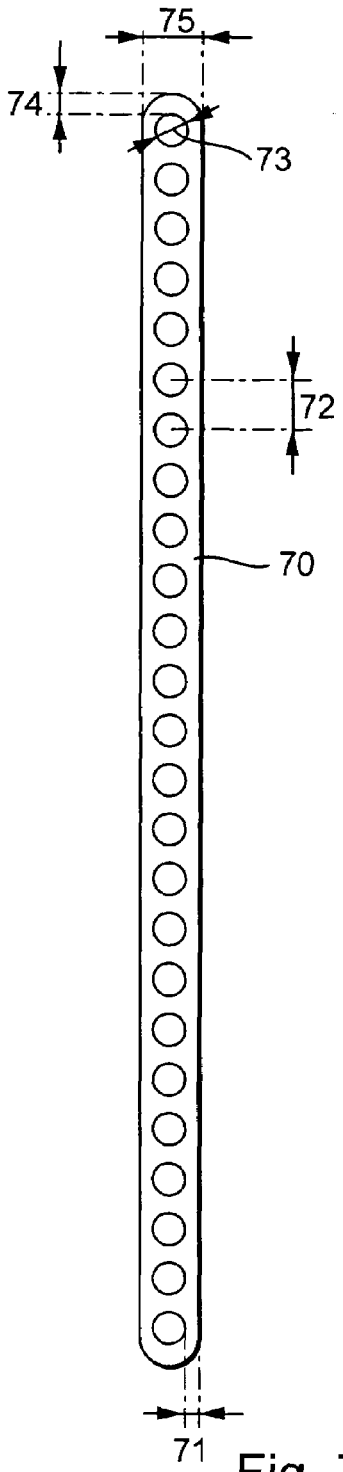
FIG. 7 shows a cross section through a flat tube for a device for exchanging heat according to the present invention.
Figure 8:
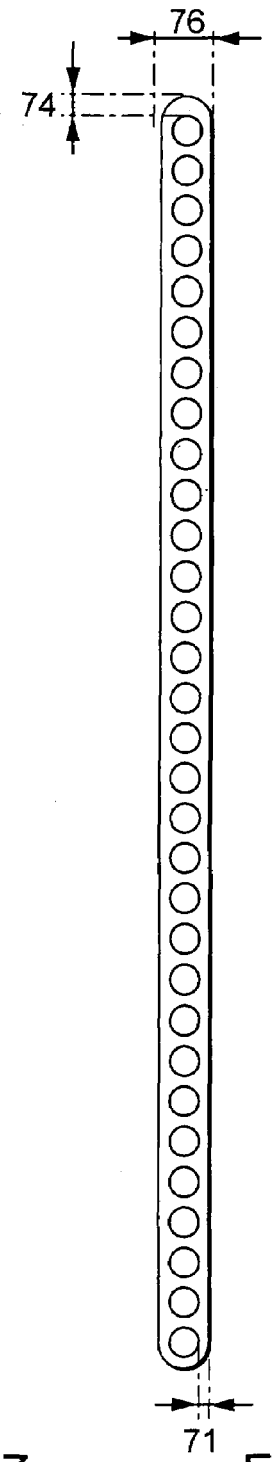
FIG. 8 shows an alternative embodiment of a flat tube in cross section.
Figure 9:
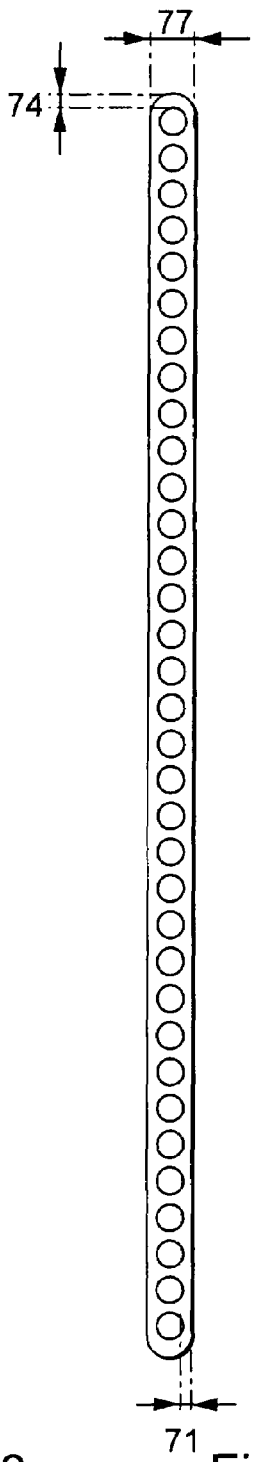
FIG. 9 shows an alternative embodiment of a flat tube for a device for exchanging heat according to the present invention in cross section.

According to a particularly preferred embodiment, FIGS. 7, 8 and 9 show further configuration forms for a flow device, in particular for a flat tube with the flow paths 73, which have a hydraulic diameter of between 0.1 and 3 mm, preferably between 0.5 and 2 mm and particularly preferably between 1.0 and 1.6 mm.

The burst pressure range of a device is, in particular, >300 bar according to the present invention, the wall thickness needing to have a minimum thickness depending on the material. According to a particularly preferred embodiment, the wall between the outer limit of the flat tube and the inner limits of the flow paths has a wall thickness which is between 0.1 and 0.3 mm, particularly preferably between 0.15 and 0.25 mm and particularly preferably between 1.17 and 2.2 mm.

FIG. 7 represents an alternative embodiment of a flow device with 25 flow paths 73, the average hydraulic diameter of which is about 1.0 mm. The tube width 75 is about 1.8 mm and the wall thickness 71 is about 0.3 mm. The distance between the flow paths 72 is about 1.6 mm. The spacing 74 of the flow path 73 and the lateral outer wall 70 is about 0.6 mm.

FIG. 8 has 28 flow paths, the hydraulic diameter being about 1.4 mm. The tube width 75 is about 2.2 mm and the wall thickness 71 is about 0.3 mm. The distance between the flow paths 72 is about 1.9 mm. The spacing 74 of the flow path 73 from the lateral outer wall 70 is about 0.6 mm.

FIG. 9 represents a flat tube with 35 flow paths, the average diameter of which is between 1.0 mm. The tube width 75 is about 1.8 mm and the wall thickness 71 is about 0.3 mm. The distance between the flow paths 72 is about 1.6 mm. The spacing 74 of the flow path 73 from the lateral outer wall 70 is about 0.6 mm.

Figure 10:
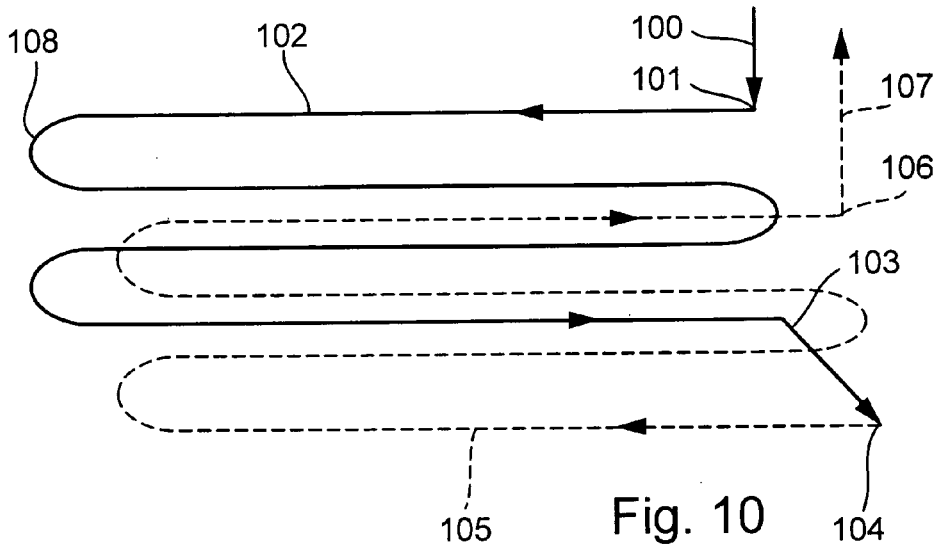
FIG. 10 shows a schematic representation of the coolant flow through a module according to the present invention.

FIG. 10 shows a schematic route of the coolant through a module of a device for exchanging heat, the reference 100 indicating the schematic representation of the coolant inlet. Via the head tube, the position of which is denoted by the reference 101, the coolant is delivered to the flow device 102 and, in the region 108, experiences the first direction change which is due to the coiled curvature of the flow device. The coolant flowing in the flow paths of the flow device opens into the transverse distributor in the region 103, and is deviated by it into the backward part of the flow device, that is to say into the backward flow paths 105.

In a corresponding way for the section 102, heat energy is also drawn from the medium flowing around in the section 105, for example the air, and is transferred to the coolant. This coolant is collected as a liquid-gas mixture in the outlet section of the head tubes 106, and is returned via the coolant discharge 107 into the pipe system which follows, for example of an air-conditioning system.

Figure 11A:
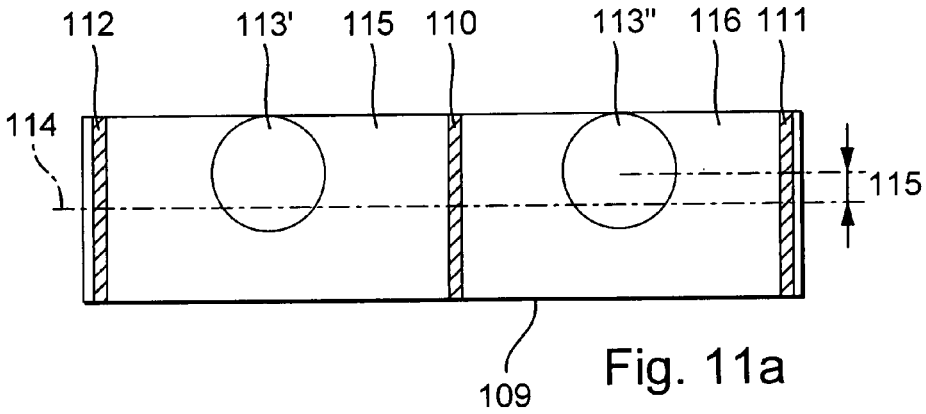
FIG. 11*a* shows a schematic representation of a head tube for a device for exchanging heat according to the present invention.

FIG. 11*a* shows a schematic representation of a header tube in the side view where, besides the partition elements 110, 111 and 112, it is also possible to see the feeds for the coolant inlet or outlet 113' and 113", respectively. According to a particularly preferred embodiment, the holes 113' and 113" are offset from the mid-axis of the header tube 114 by a distance 115, this distance being between 0 and 20 mm according to the present invention, preferably between 0 and 10 mm and particularly preferably between 0 and 5 mm. The partition element 110 subdivides the header tube into two sections 116 and 116', which constitute either the coolant inlet section or the coolant outlet section depending on the arrangement of the header tube. The partition elements 111 and 112 close the header tube off from the surroundings, and these partition elements may be arranged at a distance from the outer edge of the header tube or may be arranged flush next to it. According to another preferred embodiment, the section of the header tube may also be sealed by a solder or weld point. The feeds for the flow device are not represented in FIG. 11*a*.

Figure 11B:
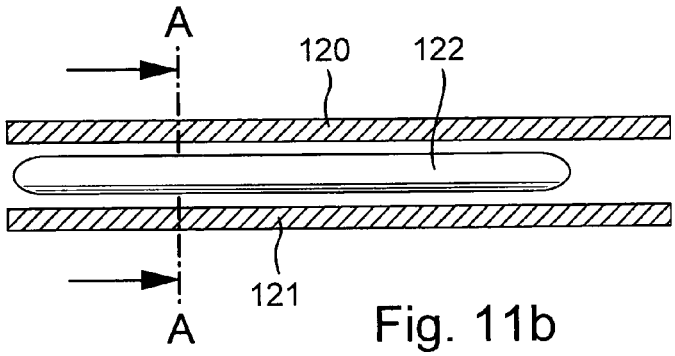
FIG. 11*b* shows a schematic representation of the feeds of a head tube for a flow device.

FIG. 11*b* shows an alternative embodiment of a feed of the flow device into a head tube. Here, besides the two branches 120 and 121 of the head tube, it is also possible to see the feed 122 which, according to a preferred embodiment, is configured so that it corresponds to the outer shape of the flat tube to be inserted. According to another embodiment the hole may also be configured so that, for example, two or more flat tubes can be accommodated in the head tube.

Figure 11C:
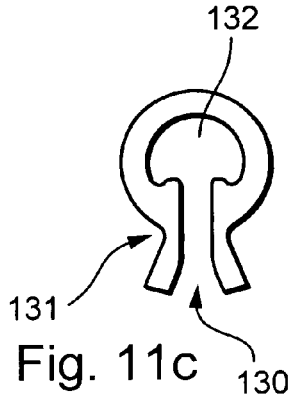
FIG. 11*c* shows a sectional representation through the head tube in FIG. 11*b* along the line A-A.

FIG. 11*c* shows the cross section through a head tube according to FIG. 11*b* along the line A-A. The representation shows the Ω-shaped basic structure of the head tube, which constitutes a particularly preferred embodiment according to the present invention. The flow device enters the feed 130 of the head tube and extends into the interior 132 of the head tube as far as a predetermined point. This embodiment furthermore provides the opportunity to connect the flow device to the head tube by clamping before the materially bonded connection of the individual components when a module or the modules are being produced. Here, in particular, the geometrical shape of a head tube according to the exemplary embodiment in FIG. 11*c* is used so that the tapered region 131 is clamped to a flow device after it has been inserted.

According to another particularly preferred embodiment, two or more flow devices may also open in a head tube with the configuration in FIG. 11*c*. A particularly preferred arrangement of the flow device is used here, as represented by the reference 54 in FIG. 5.

Figure 12:
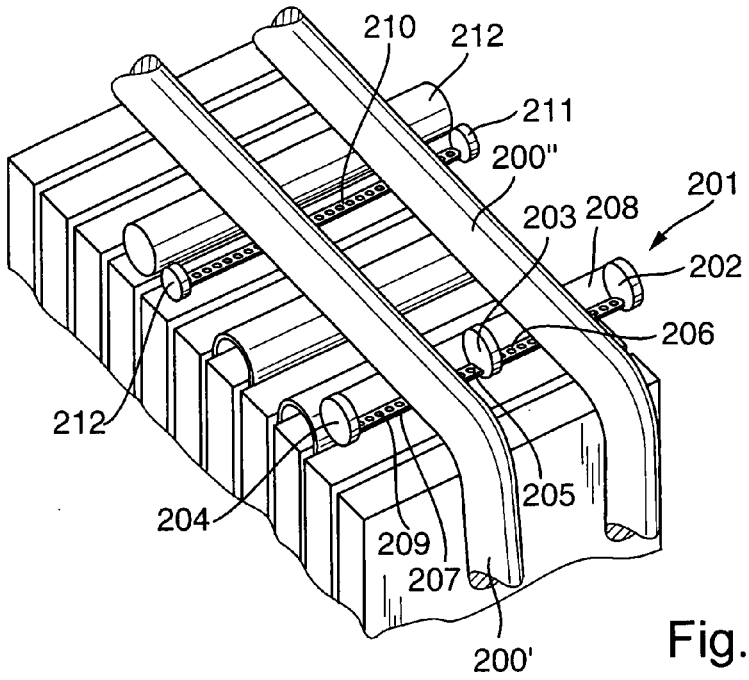
FIG. 12 shows a perspective representation of a device for exchanging heat according to the present invention.

FIG. 12 shows a perspective view of a device for exchanging heat, where besides the coolant inlet or coolant outlet 200", it is also possible to see a header tube 201 with the partition elements 202, 203 and 204. According to the exemplary embodiment which is represented, the partition element 203 extends inside the channel of the header tube 201 so that it engages in a recess of the flow device 205. The header tube 201 is furthermore subdivided by the partition element 203 into a coolant inlet section 207 and a coolant outlet 208. The coolant flows from the coolant inlet 207 via the flow paths 209 of the flow device into the transverse distributor 212, which is likewise sealed from the surroundings by two partition elements 211 and 211'. The coolant is then deviated in the transverse distributor 212 onto the returning flow paths 210 which, following on from the flow device, open in the coolant outlet section 208. The coolant is discharged by the latter via the coolant outlet 200".

Figure 13:
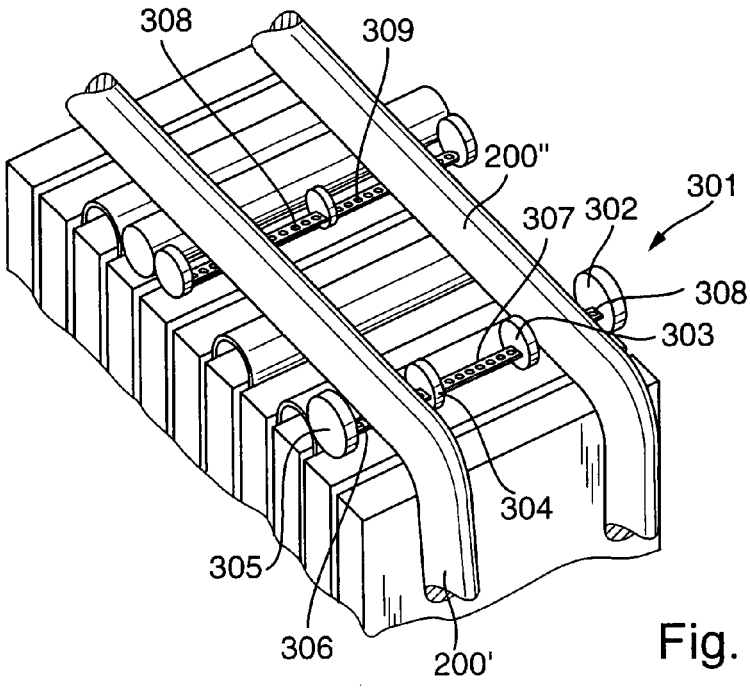
FIG. 13 shows an alternative embodiment of a device for exchanging heat according to the present invention.

FIG. 13 shows an alternative embodiment of a device for exchanging heat, in which the coolant inlet 200' and the coolant outlet 200" are connected to the head tube 301. According to this particularly preferred embodiment, the head tube 301 has four partition elements 302, 303, 304 and 305, which subdivide the head tube 301 into three sections 306, 307 and 308. The coolant is conveyed via the coolant inlet 201 into the first section of the head tube 306 and, via the flow device, into the transverse distributor section 308. From there, the coolant is in turn conveyed back to the head tube section 307 and subsequently back again to the transverse distributor section 309, before being subsequently returned back via the flow device in the third section 308 of the head tube. Following on from the section 308, the coolant is conveyed into the coolant outlet 200" and returned into the tube system, for example of an air-conditioning system.

Figure 14:
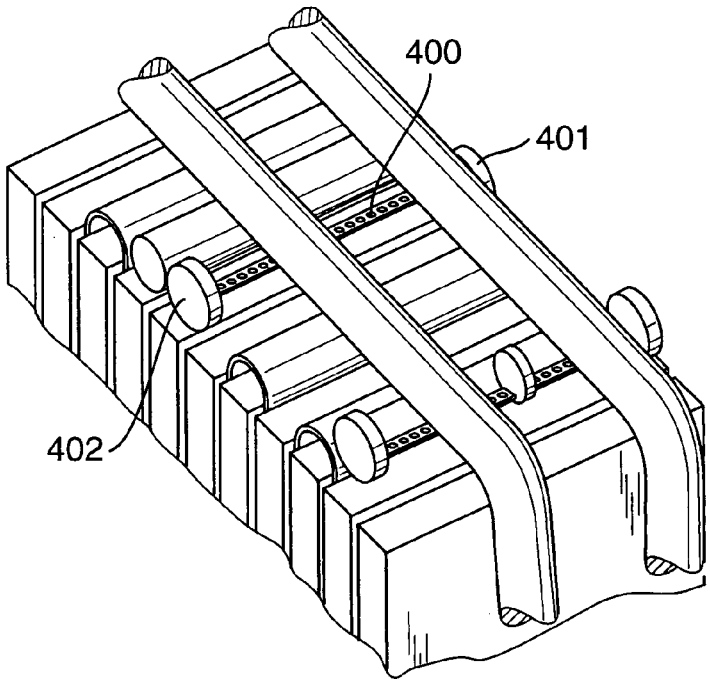
FIG. 14 shows a perspective representation of an alternative embodiment of a device for exchanging heat.

FIG. 14 shows an alternative embodiment of a device for exchanging heat in which, in particular, the transverse distributor 400 is sealed by two outwardly lying partition elements 401 and 402.

Figure 15:
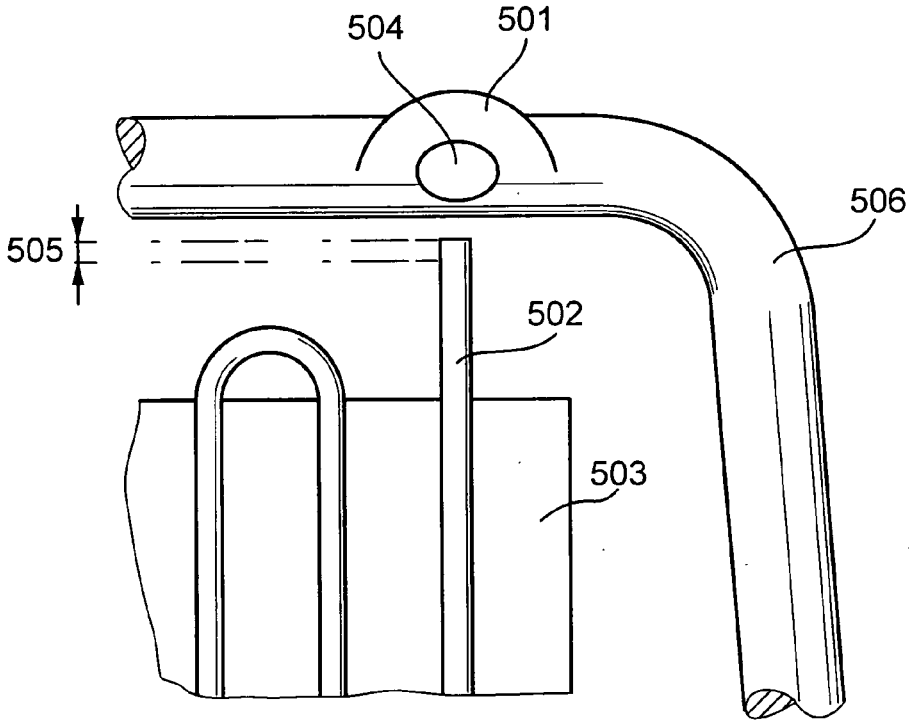
FIG. 15 shows a perspective representation of a device for exchanging heat; and in detail

FIG. 15 shows a detail of the device for exchanging heat in a perspective representation, where the flow device 502 and the schematically represented cooling fins 503 can also be seen besides the head tube 501. The representation shows, in particular in the channel of the head tube 501, the penetration depth 505 of the flow device 502 into the interior of the head tube, and the opening or openings 504 made in the coolant inlet tube, through which the head tube is fluidically connected to the coolant inlet or coolant outlet.

Figure 16:
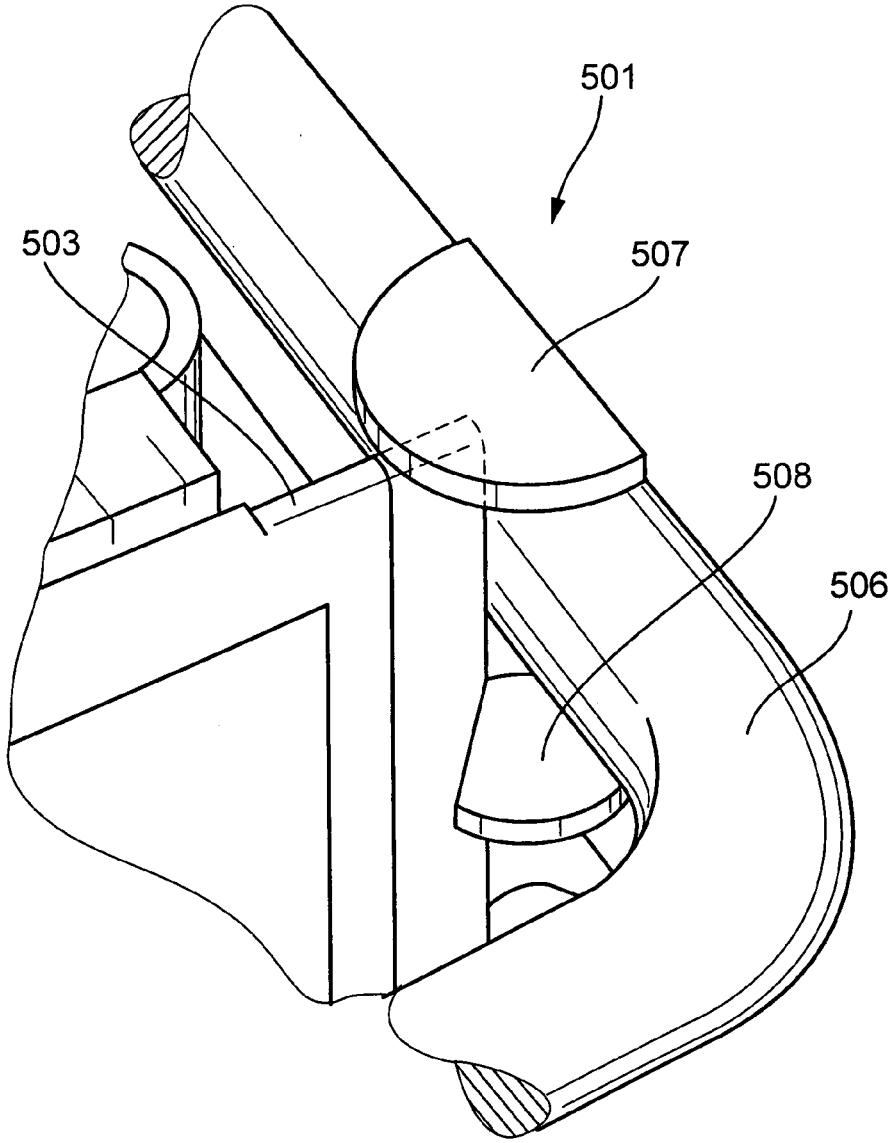
FIG. 16 shows another perspective representation in detail of a device for exchanging heat according to the present invention.

FIG. 16 shows an excerpt of the device for exchanging heat in a perspective representation, where besides the head tube 501, it is also possible to see the partition element 507, the flow device 503, the coolant inlet 506 and a further partition element 508, which subdivides the head tube 501 into an inlet and outlet section.

Figure 17:
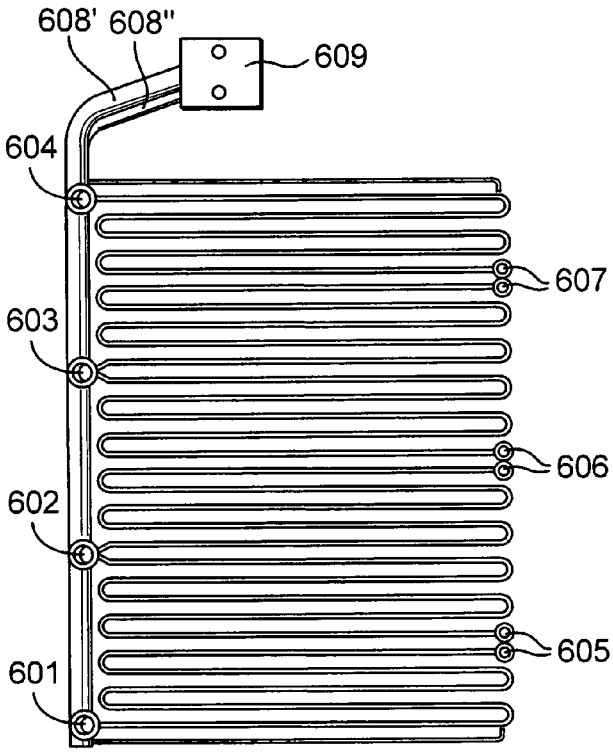
FIG. 17 shows a side view of an alternative embodiment of a device for exchanging heat according to the present invention.

FIG. 17 shows an alternative embodiment of a device for exchanging heat according to the present invention, the head tubes 601, 602, 603 and 604 of which are arranged on one side of the device and opposite the transverse distribution tubes 605, 606 and 607. The coolant inlet 608" and the coolant outlet 608' furthermore open in a coupling device 609, which connects the two pipes to the pipe system, for example of an air-conditioning system.

Figure 18:
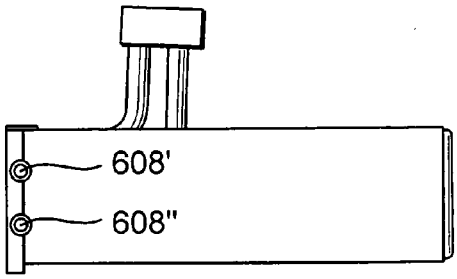
FIG. 18 shows a side view of a device for exchanging heat in FIG. 17.

FIG. 18 is a side view of the device for exchanging heat according to FIG. 17. Here, in particular, it is possible to see the arrangement of the coolant inlet 608' and of the coolant outlet 608", the midlines of which are respectively arranged offset by a different amount from the midline of the header tubes. The two tubes also have a different cross section, in order to accommodate the differing density of the coolant before and after the device for exchanging heat.

Figure 19:
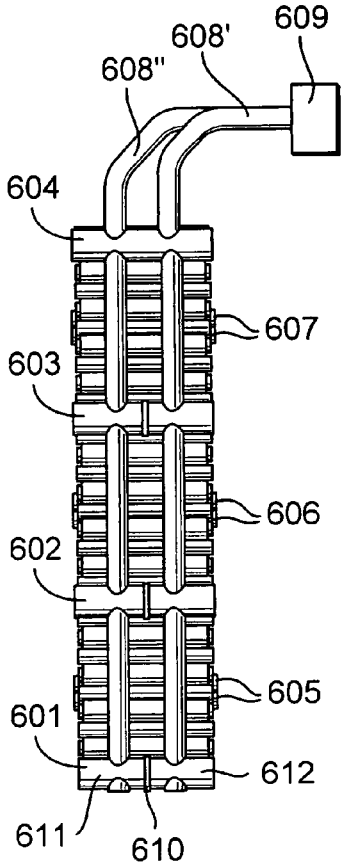
FIG. 19 shows a plan view of the alternative embodiment of a device for exchanging heat according to the present invention in FIG. 17.

FIG. 19 shows the plan view of the device for exchanging heat according to FIG. 17. Besides the header tubes 601, 602, 603 and 604, it is also possible to see the coolant inlet 608' and the coolant outlet 608", the connection device 609 and the transverse distribution tubes 605, 606 and 607. The header tubes are furthermore subdivided into an outlet section 611 and an inlet section 612 by the partition elements 610.

Figure 20:
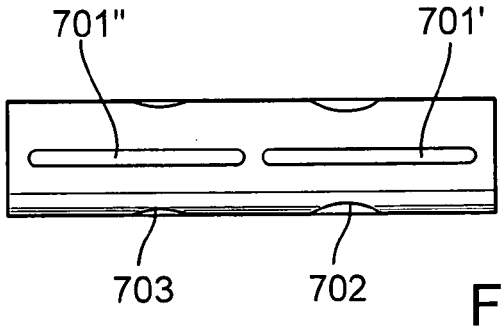
FIG. 20 shows a schematic representation of a head tube for a device according to the present invention.
Figure 21:
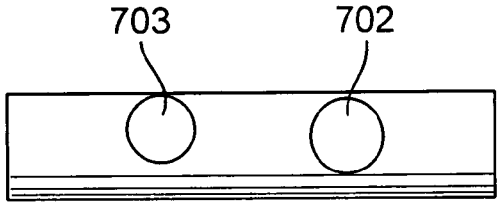
FIG. 21 shows the side view of the head tube in FIG. 20.

FIGS. 20 and 21 show a header tube for a device according to the present invention which, besides two feeds 700' and 701", also has the two holes 702 and 703 for the coolant inlet and the coolant outlet. According to a particularly preferred embodiment, the coolant inlet has a smaller diameter than the coolant outlet since, when the device for exchanging heat is being used as an evaporator, the specific density of the coolant is reduced by evaporation.

Figure 22:
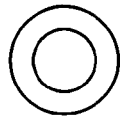
FIG. 22 shows a side view from the left of the head tube in FIG. 21.

FIG. 22 shows the header tube of FIG. 21 in the side view.

Figure 23:
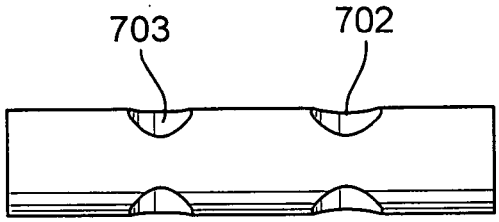
FIG. 23 shows a view from below of the head tube for a device according to the present invention in FIG. 20.

FIG. 23 shows the head tube of FIG. 20 in a plan view where, in particular, the two holes 702 and 703 for the coolant inlet and the coolant outlet can be seen.

Figure 24:
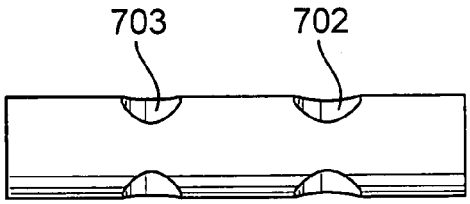
FIG. 24 shows the view from below of an alternative embodiment of a head tube according to the present invention.

FIG. 24 shows another embodiment of a head tube according to the present invention.

Besides the different flow cross sections for the coolant inlet 703 and the coolant outlet 702, this embodiment has four feeds 705, 706, 707 and 708 for a flow device, which open in the channel, i.e. the interior, of the head tube.

Figure 25:
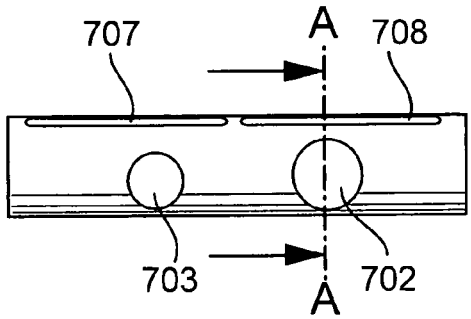
FIG. 25 shows the side view of the head tube in FIG. 24.
Figure 27:
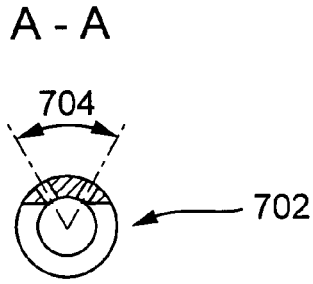
FIG. 27 shows a sectional representation of the head tube in FIG. 25 along the section line A-A.

FIG. 25 shows the side view of such a head tube, the feeds of which for the flow device are represented by the references 707 and 708. In particular, the angle 704 determines the way in which the flow devices of FIG. 27 open into the interior of the head tube.

Figure 26:
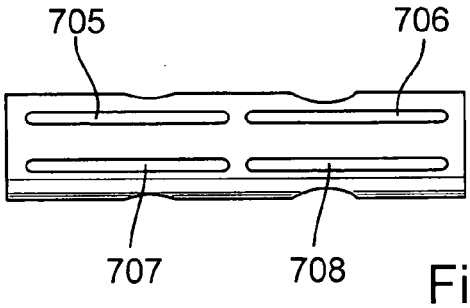
FIG. 26 shows the view from above of the head tube in FIG. 24.
Figure 28:
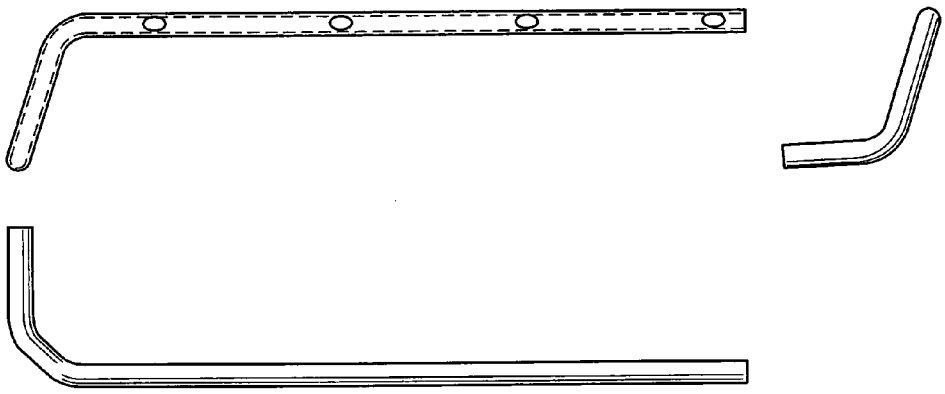
FIG. 28 shows three views of a coolant inlet or outlet.
Figure 29:
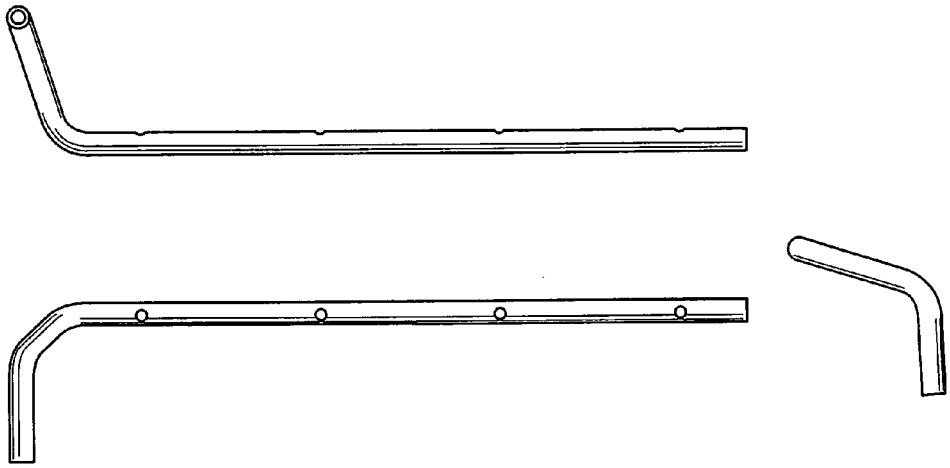
FIG. 29 shows three views of an alternative embodiment of a coolant inlet or coolant outlet.
Figure 30:
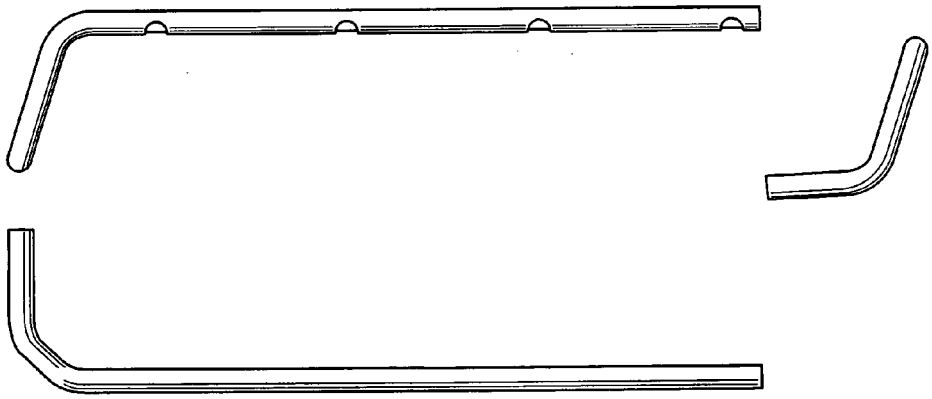
FIG. 30 shows three views of another alternative embodiment of a coolant inlet or outlet.
Figure 31:
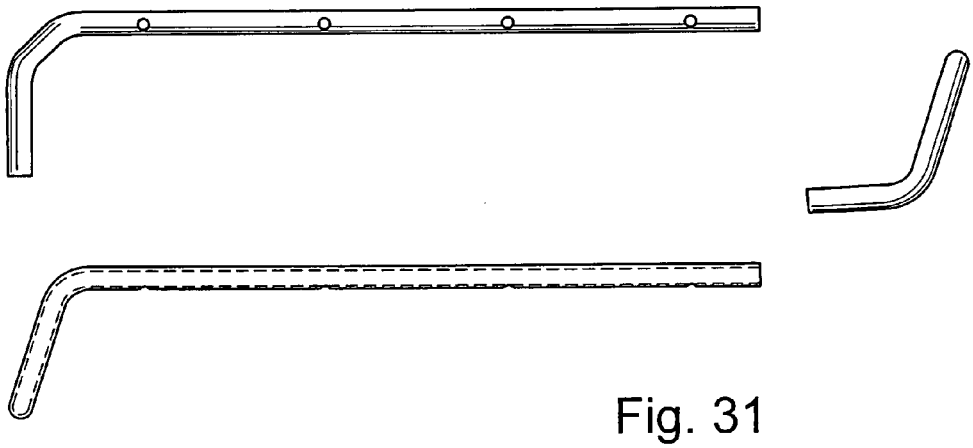
FIG. 31 shows three views of another alternative embodiment of a coolant inlet or coolant outlet.

FIG. 26 shows the view from below of a head tube according to the present invention, which has four feeds 705, 706, 707 and 708 for the flow device.

FIGS. 28, 29, 30 and 31 show different embodiments of the coolant inlet and coolant outlet. Besides the arrangement of the outlet openings, the exemplary embodiments differ by the configuration of the holes for the transition into the head tubes, and their hydraulic diameters.

The invention claimed is:

1. A device for exchanging heat for use in a motor vehicle air-conditioning system, comprising:

at least one coolant inlet and at least one coolant outlet, which open into at least one header tube, the at least one header tube being subdivided by at least one partition element into at least one inlet section and at least one outlet section;

at least one flow device which has at least two flow paths arranged at least partially parallel to one another; and at least one transverse distributor by which the flow paths of the flow device are fluidically connected so that the inlet section is fluidically connected to the outlet section of the header tube, wherein the at least one header tube, the at least one coolant inlet, the at least one coolant outlet, the at least one flow device, and the at least one transverse distributor are components which form a first module, and wherein the at least one coolant inlet, the at least one coolant outlet, the at least one header tube, and the at least one transverse distributor are arranged on one side of the first module.

2. The device for exchanging heat as claimed in claim 1, further comprising a second module with at least one coolant inlet and at least one coolant outlet, wherein the first and second modules are connected together such that the at least one coolant inlet and the at least one coolant outlet of each module are fluidically connected together.

3. The device for exchanging heat as claimed in claim 2, wherein the first and second modules are hydraulically connected in parallel.

4. The device for exchanging heat as claimed in claim 2, wherein the first and second modules are interconnected, and wherein the at least one coolant inlet and the at least one coolant outlet of each module are formed integrally.

5. The device for exchanging heat as claimed in claim 2, wherein the first and second modules communicate with one another via the at least one transverse distributor.

6. The device for exchanging heat as claimed in claim 1, wherein openings of the at least two flow paths of the at least one flow device open into interiors of the at least one header tube and of the at least one transverse distributor.

7. The device for exchanging heat as claimed in claim 1, wherein the at least one partition element subdivides the at least one header tube into inlet and outlet sections in a gas-tight and liquid-tight manner.

8. The device for exchanging heat as claimed in claim 1, wherein the at least one flow device is a flat tube.

9. The device for exchanging heat as claimed in claim 1, wherein the at least one flow device has at least two flat tubes arranged at least partially parallel, wherein channels of the flat tubes constitute the flow paths.

10. The device for exchanging heat as claimed in claim 1, wherein the flow device has at least one flat tube, which is made of at least one material from the group of metals, plastics, fiber-reinforced plastics, and composites.

11. The device for exchanging heat as claimed in claim 1, wherein the first module has cooling fins connected at least to an outer surface of the at least one flow device for promoting transport of thermal energy.

12. The device for exchanging heat as claimed in claim 11, wherein a gaseous medium can flow around the at least one flow device and the cooling fins.

13. The device for exchanging heat as claimed in claim 12, wherein heat transfer between coolant inside the at least one flow device and the gaseous medium, flowing around the cooling fins and the at least one flow device, takes place essentially by convection and heat conduction.

14. The device for exchanging heat as claimed in claim 1, wherein the at least one header tube has an essentially cylindrical basic shape and a predetermined number of feeds are arranged on its circumference, through which the at least one coolant inlet, the at least one coolant outlet and the at least one flow device extend into an interior of the header tube.

15. The device for exchanging heat as claimed in claim 1, wherein the at least one header tube has a projection on an edge of at least one feed, which engages in a feed of the at least one coolant inlet or the at least one coolant outlet.

16. The device for exchanging heat as claimed in claim 1, wherein coolant flows through the device of exchanging heat, and wherein the coolant is a fluid which has at least one component from the group of gases hydrocarbons, and liquids.

17. The device for exchanging heat as claimed in claim 1, wherein junction regions of components through which fluid flows are connected together in a gas-tight and liquid-tight manner with respect to medium flowing around.

18. The device for exchanging heat as claimed in claim 1, further comprising frame elements on at least two mutually opposite sides, which extend over at least a part of a side area of the device for exchanging heat and have a U-shaped profile, and wherein the frame elements are connected to at least one component by friction locking, by a form-fit, by a bonding material, or by a combination thereof.

19. The device for exchanging heat as claimed in claim 1, wherein the at least one flow device has at least one recess in a vicinity of feeds arranged in a circumference of the header tube, in which the at least one partition element of the header tube engages.

20. The device for exchanging heat as claimed in claim 1, wherein the at least one partition element of the header tube has a recess, in which the at least one flow device engages in the header tube in a vicinity of feeds arranged on a circumference of the header tube.

21. The device for exchanging heat as claimed in claim 1, wherein flow cross sections of the at least one header tube, of the at least one coolant inlet, of the at least one coolant outlet, or of a combination thereof are configured so that pressure of fluid is essentially equal or has a predetermined value in at least two inlet sections, two outlet sections, or a combination of inlet and outlet sections.

22. The device for exchanging heat as claimed in claim 1, wherein the at least one header tube is a plurality of header tubes, and wherein coolant feeds are arranged on circumferences of the plurality of header tubes and have different flow cross sections.

23. The device for exchanging heat as claimed in claim 1, wherein coolant feeds are arranged on a circumference of the at least one header tube and in a vicinity of the at least one coolant inlet or the at least one coolant outlet, and wherein flow cross sections of the coolant feeds increase in a direction of a decreasing pressure, which coolant has inside the at least one coolant inlet or the at least one coolant outlet, respectively, during operation.

24. The device for exchanging heat as claimed in claim 1, wherein coolant feeds are arranged on a circumference of the at least one header tube and in a vicinity of the at least one coolant inlet or the at least one coolant outlet, and wherein flow cross sections of the coolant feeds increase in a direction of a decreasing density, which coolant has inside the at least one coolant inlet or the at least one coolant outlet, respectively, during operation.

25. The device for exchanging heat as claimed in claim 1, wherein the at least one header tube is a plurality of header tubes, wherein the plurality of header tubes have coolant inlet feeds and coolant outlet feeds, wherein the coolant inlet feeds have different flow cross sections, and wherein the coolant outlet feeds have flow cross sections which are at least as large as the flow cross section of the largest coolant inlet feed.

26. The device for exchanging heat as claimed in claim 1, wherein volumes of the inlet and outlet sections have a predetermined ratio, wherein the predetermined ratio is 1:1, 1:2, 1:4, 1:10 or any intermediate values therebetween, wherein the intermediate values are whole numbers or positive non-whole numbers.

27. The device for exchanging heat as claimed in claim 1, wherein the at least one flow device has at least one curved section, in which an extension direction changes by 5°, 10°, 25°, 30°, 45°, 60°, 90°, 120°, 180° or any intermediate value therebetween.

28. The device for exchanging heat as claimed in claim 1, wherein the at least two flow paths are two hydraulically consecutive flow paths arranged in an approximately U-shaped tube.

29. The device for exchanging heat as claimed in claim 1, wherein the at least two flow paths comprise two flow paths arranged next to each other in a primary flow direction of a medium flowing around the at least one flow device.

30. The device for exchanging heat as claimed in claim 1, wherein the at least two flow paths comprise two flow paths arranged one behind the other in a primary flow direction of a medium flowing around the at least one flow device.

31. The device for exchanging heat as claimed in claim 1, wherein the at least two flow paths comprise a number of flow paths divisible by four.

32. The device for exchanging heat as claimed in claim 1, wherein the at least two flow paths comprise flow paths of the first module and a second neighboring module, wherein the first and second modules extend with mirror symmetry with respect to one another.

33. The device for exchanging heat as claimed in claim 1, wherein the at least two flow paths comprise flow paths having different flow cross sections.

34. The device for exchanging heat as claimed in claim 1, wherein flow cross sections of the at least two flow paths increase in a direction of a decreasing density, which coolant has inside the module during operation.

35. The device for exchanging heat as claimed in claim 1, wherein all flow paths of the module are flush with one another in a primary flow direction of a medium flowing around the at least one flow device.

36. The device for exchanging heat as claimed in claim 1, wherein the at least one transverse distributor has a second partition element, which subdivides the transverse distributor into at least two flow sections.

37. The device for exchanging heat as claimed in claim 1, wherein the at least one flow device extends into an interior of the at least one transverse distributor.

38. An apparatus for exchanging air in a motor vehicle air-conditioning system, comprising:

air flow paths, airflow control elements, at least one air delivery device, and a housing accommodating at least one device for exchanging heat as claimed in claim 1.

39. An apparatus for exchanging heat in a motor vehicle air-conditioning system, comprising:

a condenser, a compressor, a throttle valve, a manifold, and at least one device for exchanging heat as claimed in claim 1.

40. A device for exchanging heat for use in a motor vehicle air-conditioning system, comprising:

at least one coolant inlet and at least one coolant outlet, which open into at least one header tube, the at least one header tube being subdivided by at least one partition element into at least one inlet section and at least one outlet section;

at least one flow device which has at least two flow paths arranged at least partially parallel to one another; and at least one transverse distributor by which the flow paths of the flow device are fluidically connected so that the inlet section is fluidically connected to the outlet section of the header tube, wherein the at least one partition element has a recess in which the at least one flow device engages in the header tube in a vicinity of feeds arranged on the at least one header tube.

41. The device for exchanging heat as claimed in claim 40, wherein the at least one header tube, the at least one coolant inlet, the at least one coolant outlet, the at least one flow device, and the at least one transverse distributor are components which form a first module.

42. The device for exchanging heat as claimed in claim 41, further comprising a second module with at least one coolant inlet and at least one coolant outlet, wherein the first and second modules are connected together such that the at least one coolant inlet and the at least one coolant outlet of each module are fluidically connected together.

43. The device for exchanging heat as claimed in claim 42, wherein the first and second modules are hydraulically connected in parallel.

44. The device for exchanging heat as claimed in claim 40, wherein openings of the at least two flow paths of the at least one flow device open into interiors of the at least one header tube and of the at least one transverse distributor.

45. The device for exchanging heat as claimed in claim 40, wherein the at least one partition element subdivides the at least one header tube into inlet and outlet sections in a gas-tight and liquid-tight manner.

46. The device for exchanging heat as claimed in claim 40, wherein the at least one flow device is a flat tube.

47. The device for exchanging heat as claimed in claim 40, wherein the at least one flow device has at least two flat tubes arranged at least partially parallel, wherein channels of the flat tubes constitute the flow paths.

48. The device for exchanging heat as claimed in claim 40, wherein the at least one header tube has an essentially cylindrical basic shape and the feeds on the at least one header tube are arranged on its circumference, through which the at least one coolant inlet, the at least one coolant outlet and the at least one flow device extend into an interior of the header tube.

49. The device for exchanging heat as claimed in claim 40, further comprising frame elements on at least two mutually opposite sides, which extend over at least a part of a side area of the device for exchanging heat and have a U-shaped profile, and wherein the frame elements are connected to at least one component by friction locking, by a form-fit, by a bonding material, or by a combination thereof.

50. The device for exchanging heat as claimed in claim 40, wherein the feeds are coolant feeds arranged on a circumference of the at least one header tube and in a vicinity of the at least one coolant inlet or the at least one coolant outlet, and wherein flow cross sections of the coolant feeds increase in a direction of a decreasing pressure, which coolant has inside the at least one coolant inlet or the at least one coolant outlet, respectively, during operation.

51. The device for exchanging heat as claimed in claim 40, wherein the feeds are coolant feeds arranged on a circumference of the at least one header tube and in a vicinity of the at least one coolant inlet or the at least one coolant outlet, and wherein flow cross sections of the coolant feeds increase in a direction of a decreasing density, which coolant has inside the at least one coolant inlet or the at least one coolant outlet, respectively, during operation.

52. The device for exchanging heat as claimed in claim 40, wherein volumes of the inlet and outlet sections have a predetermined ratio, wherein the predetermined ratio is 1:1, 1:2, 1:4, 1:10 or any intermediate values therebetween, wherein the intermediate values are whole numbers or positive non-whole numbers.

53. The device for exchanging heat as claimed in claim 40, wherein the at least one flow device has at least one curved section, in which an extension direction changes by 5°, 10°, 25°, 30°, 45°, 60°, 90°, 120°, 180° or any intermediate value therebetween.

54. The device for exchanging heat as claimed in claim 40, wherein the at least two flow paths are two hydraulically consecutive flow paths arranged in an approximately U-shaped tube.

55. The device for exchanging heat as claimed in claim 40, wherein the at least two flow paths comprise two flow paths arranged next to each other in a primary flow direction of a medium flowing around the at least one flow device.

56. The device for exchanging heat as claimed in claim 40, wherein the at least two flow paths comprise two flow paths arranged one behind the other in a primary flow direction of a medium flowing around the at least one flow device.

57. The device for exchanging heat as claimed in claim 40, wherein the at least two flow paths comprise a number of flow paths divisible by four.

58. The device for exchanging heat as claimed in claim 40, wherein the at least two flow paths comprise flow paths having different flow cross sections.

59. The device for exchanging heat as claimed in claim 40, wherein the at least one transverse distributor has a second partition element, which subdivides the transverse distributor into at least two flow sections.

60. The device for exchanging heat as claimed in claim 40, wherein the at least one flow device extends into an interior of the at least one transverse distributor.

61. The device for exchanging heat as claimed in claim 40, wherein the at least two flow paths comprises a row of flow paths in which flow paths are located on two opposite sides of a flow path hydraulically consecutive to the at least one header tube.

62. An apparatus for exchanging air in a motor vehicle air-conditioning system, comprising:

air flow paths, airflow control elements, at least one air delivery device, and a housing accommodating at least one device for exchanging heat as claimed in claim 40.

63. An apparatus for exchanging heat in a motor vehicle air-conditioning system, comprising:

a condenser, a compressor, a throttle, a manifold, and at least one device for exchanging heat as claimed in claim 40.

* * * * *